United States Patent [19]

Pierrat

[11] 4,300,605

[45] Nov. 17, 1981

[54] LOG SPLITTER WITH PROTECTION AGAINST TWISTING MOMENTS

[76] Inventor: Michel A. Pierrat, 48 Farrwood Dr., Andover, Mass. 01810

[21] Appl. No.: 109,134

[22] Filed: Jan. 2, 1980

Related U.S. Application Data

[63] Continuation-in-part of Ser. No. 873,060, Jan. 27, 1978, abandoned.

[51] Int. Cl.[3] ..... B27L 7/00

[52] U.S. Cl. ..... 144/193 A; 254/93 H

[58] Field of Search ..... 254/93 H; 144/193 R, 144/193 A, 193 C, 193 D, 3 K

[56] References Cited

U.S. PATENT DOCUMENTS

| | | | |
|---|---|---|---|
| 2,704,093 | 3/1955 | Brown | 144/193 A |
| 2,851,072 | 9/1958 | Gerjets et al. | 144/193 A |
| 3,285,304 | 11/1966 | Fuller | 144/193 A |
| 3,982,572 | 9/1976 | Kortendick | 144/193 D |
| 4,081,008 | 3/1978 | Dilling | 144/193 A |
| 4,102,373 | 7/1978 | Winiasz | 144/193 A |

FOREIGN PATENT DOCUMENTS

| | | | |
|---|---|---|---|
| 2902783 | 8/1979 | Fed. Rep. of Germany | 144/193 A |

*Primary Examiner*—W. D. Bray
*Attorney, Agent, or Firm*—E. Thorpe Barrett

[57] ABSTRACT

A vertical type log splitter for home use in which a splitting wedge is releasably secured to upright frame members and a power-driven ram guide supports a log to be split and forces it into the splitting wedge. To protect the frame of the log splitter from damage caused by twisting moments and to provide a visual indication of the presence of such moments, the ram guide is tiltably mounted and arranged to abort the splitting action when the angle of tilt exceeds a predetermined angle.

15 Claims, 6 Drawing Figures

LOG SPLITTER WITH PROTECTION AGAINST TWISTING MOMENTS

CROSS-REFERENCE TO RELATED APPLICATIONS

This application is a continuation-in-part of my co-pending application Ser. No. 873,060, filed Jan. 27, 1978, entitled "LOG SPLITTER", now abandoned. Reference is made to my co-pending application Ser. No. 53,199 filed June 1979 entitled "LOG SPLITTER WITH IMPROVED CLAMP".

BACKGROUND OF THE INVENTION

This invention relates to log splitters and in particular to log splitters intended for home use. Such a log splitter must meet demanding requirements for economy and portability. The cost must be low enough that the user can make substantial savings by the use of the splitter and it must be light enough that it can be readily moved about by one person. Such a log splitter, however, must also be capable of exerting the large forces, for example of the order of 10 or 12 tons, required for splitting logs and which are accompanied from time to time by the inevitable generation of large twisting moments. The requirement for light weight precludes the use of a construction sturdy enough to withstand the direct forces of these twisting moments. However, by supporting the log substantially at one point and applying the splitting force at a directly opposite point, the twisting moments transmitted to the supporting frame can be minimized. Nevertheless, if adequate splitting force is to be provided, certain logs will cause the generation of twisting moments large enough to permanently distort the frame of the splitter.

I have, previous to the present invention, attempted to protect the frame from damage by the use of a tiltable ram guide mounted atop the power-driven ram and having guide wheels at each end, positioned at a level considerably below the point of engagement with the ram head, that engaged frame members of circular cross section. However, the inevitable twisting moments generally cause a rotation of the ram guide about its longitudinal axis, and this rotation during the upward movement of the ram guide causes the guide wheels to follow an angular path along the frame members and to disengage therefrom even though no twisting moments have been generated of sufficient magnitude to damage the log splitter.

SUMMARY OF THE INVENTION

The invention is embodied in a log splitter in which the log to be split is centrally supported at one end while the opposite end of the log is engaged by the point of a splitting wedge that is clamped in position and caused to split the log by forces applied to the log support. In accordance with the present invention, the log is supported on a ram guide having a central area making contact with the log and to which is applied the force that pushes the log into the splitting wedge. The ram guide is arranged so that the generation of off-center forces in excess of a certain magnitude will cause the ram guide to tilt while notched end portions of the ram guide, which encompass the width of the supporting frame members, move parallel with the axes of the frame members. This tilting of the ram guide gives a visual indication to the operator that twisting moments are being generated and, if the forces are allowed to become large enough, causes the ram guide to disengage from the frame members and abort the splitting operation before the forces reach a magnitude that would damage the log splitter.

DESCRIPTION OF THE PREFERRED EMBODIMENT

Figure 1:
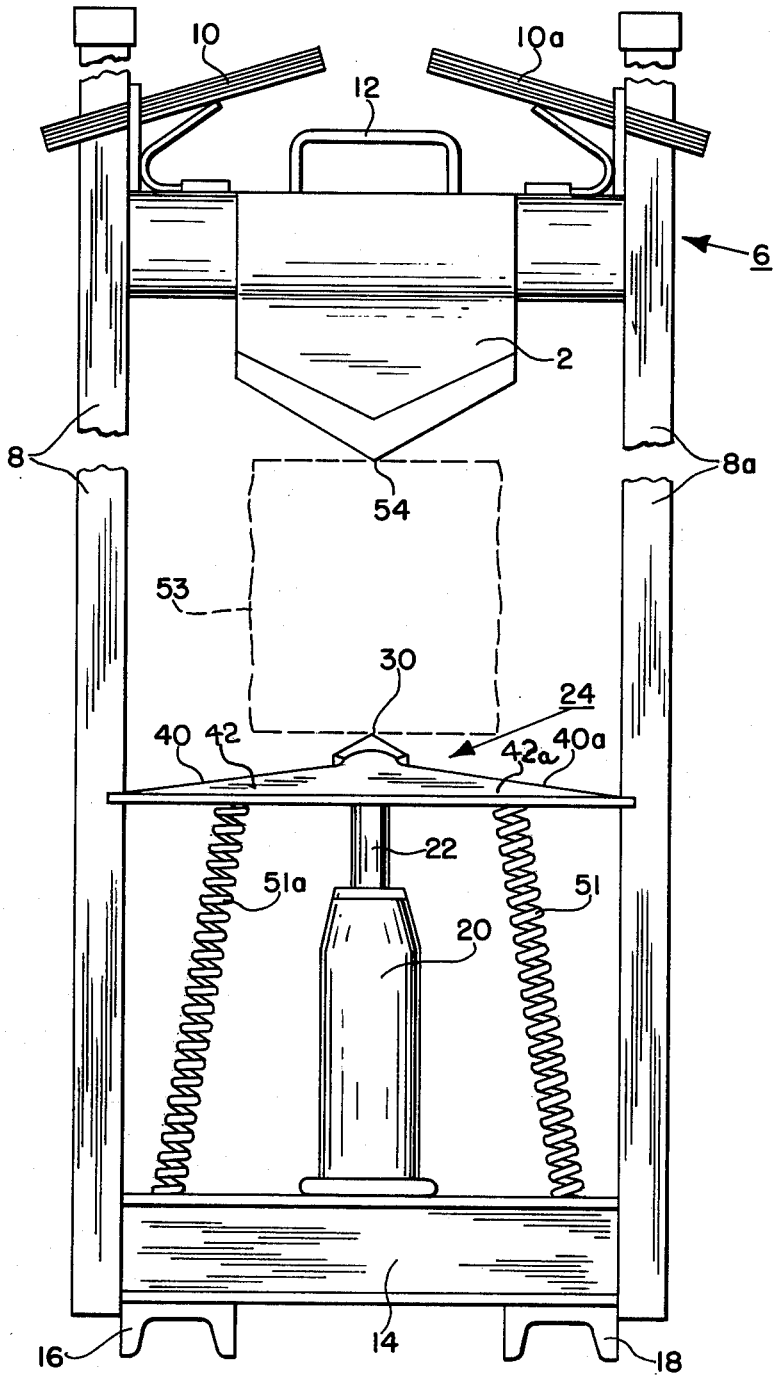
FIG. 1 is a front view of a log splitter embodying the invention.
Figure 2:
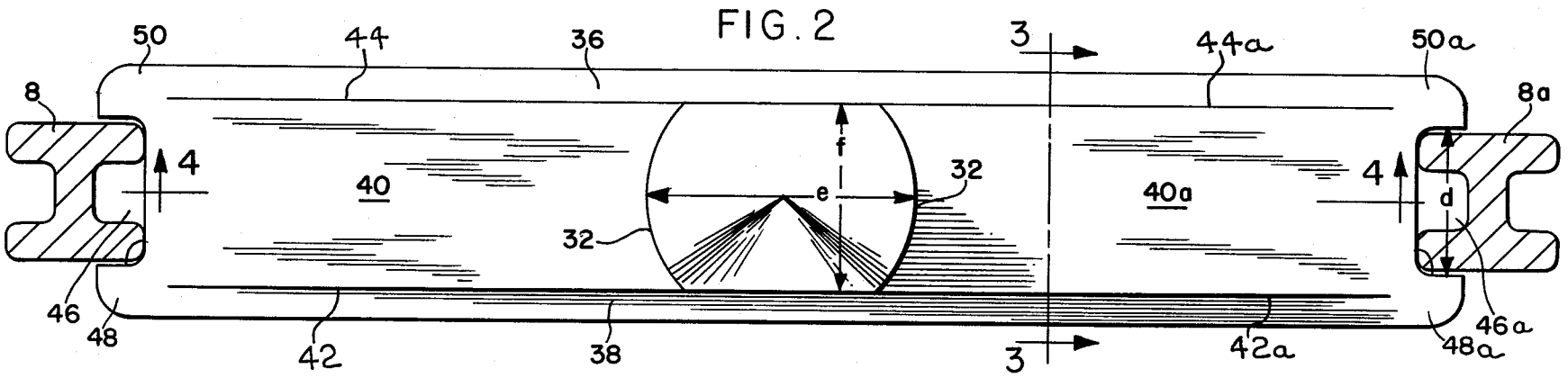
FIG. 2 is a top view of the ram guide forming part of the log splitter shown in FIG. 1.

As shown in FIG. 1, a splitting wedge 2 is mounted on a carriage assembly, generally indicated at 6, which is releasably clamped to two spaced, parallel, upright frame members 8 and 8*a*. Two clamps 10 and 10*a* by which the carriage is secured to the frame members may for example be of the type described in the above-identified co-pending applications and are caused to release the carriage assembly from the frame members 8 and 8*a* by manually actuating the clamps with the aid of a handle 12. The frame members 8 and 8*a* may be formed of lengths of pipe, but I prefer to use H beams of cold rolled steel as shown in FIG. 2.

The frame members 8 and 8*a* are supported by a base 14 that is welded to a pair of perpendicular U-shaped runners 16 and 18 on which the log splitter rests. This base 14 also serves as a support for a hydraulic jack 20, which sits upon but is not secured to the base 14, and which has an upwardly extending ram 22 on which rests a ram guide, generally indicated at 24. The upper end of the ram 22 carries an enlarged head 26 (FIG. 4) having a conical upper surface 28 that fits into a corresponding socket formed in the under surface of a conical central section 30 of the ram guide 24. The ram guide is thus self-centering on the ram 22 but is not otherwise secured thereto. By terminating the ram head 26 in a cone, as shown, the ram guide resists tilting until the twisting moments become great enough that the wall of the socket area of the ram guide ridges up on the tip of the cone. The force required to tilt the ram guide is a function of the splitting force and the steepness of the cone on the end of the ram head and will be adjusted so that the force required for tilting will always be less than that which would damage the frame of the log splitter. Alternatively, the top of the ram head may be ball shaped and the socket area of the ram head shaped accordingly. With this arrangement, the force required to tilt the ram guide is primarily a function of the splitting force. I prefer, however, not to provide a flat surface on the end of the ram head because of the loss of the self-centering feature and because when the ram guide tilts, excessive forces may be concentrated on one edge of the ram head.

Figure 3:
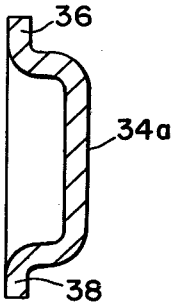
FIG. 3 is a cross sectional view taken along line 3—3 of FIG. 2.
Figure 4:
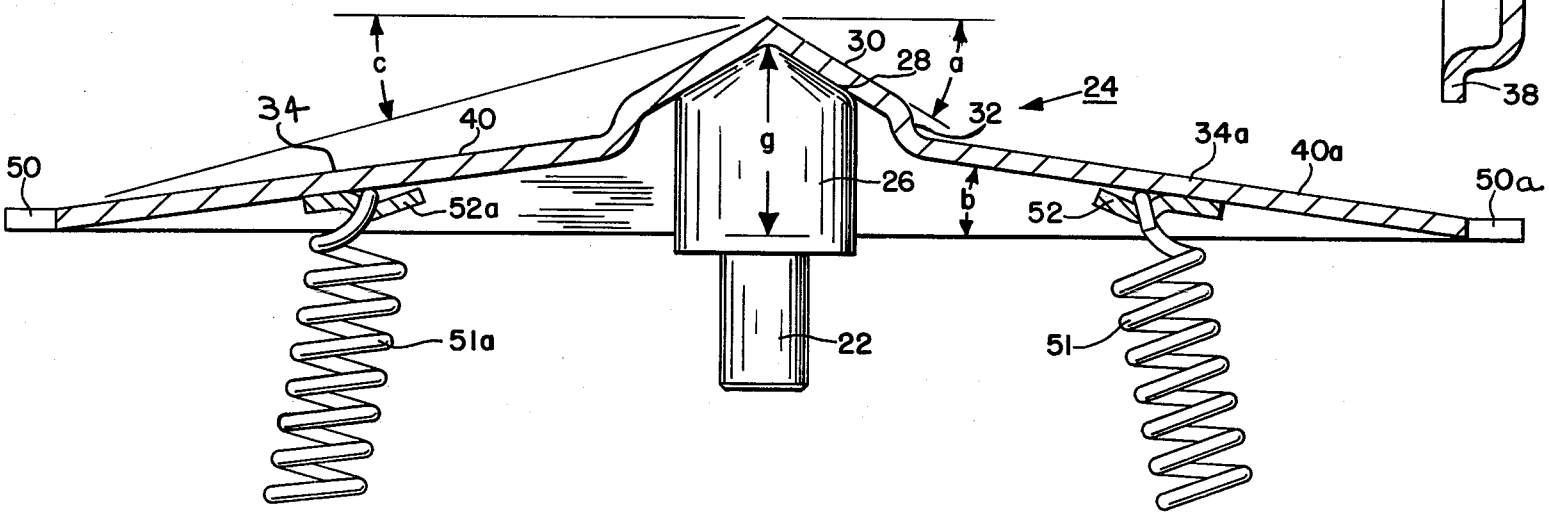
FIG. 4 is a longitudinal sectional view taken along line 4—4 of FIG. 2.

For reasons to be explained later, the conical upper surface of the ram guide 24 slopes downwardly from its apex at an angle of 30 degrees from the horizontal as indicated by the angle "a" in FIG. 4. The conical central section of the ram terminates in a short arcuate wall 32 that leads to two opposing outwardly-extending channel sections 34 and 34*a*. The two channel sections are identical in construction and only one of them is described in detail. In the other section, similar portions are referred to by similar numerals followed by the suffix "a". The channel section 34 is generally U-shaped as shown in FIG. 3, with outwardly extending flanges 36 and 38 along its lower edges for reinforcement of the structure. The upper surface 40 of the channel section slopes downwardly so that the height of the side walls 42 and 44 (FIGS. 1 and 2) of the channel section decreases outwardly from the center of the ram guide 24. The slope of the surface 40 of the channel section is less than the slope of the upper surface of the conical central section 30 and, in this example, is 8½° from the horizontal as shown by the angle "b" in FIG. 4. The angle between the horizontal and a line connecting the apex of the central conical section 30 to the outer end of the ram guide 24 is 15 degrees as indicated by the angle "c" in FIG. 4. The outer end of the channel section 34 terminates in a notch 46 that forms ears 48 and 50 that extend on opposite sides of the frame member 8. The width of the notch 46 and 46*a*, as indicated at "d" in FIG. 2, is greater than the width of the frame member 8 along which it moves to provide clearance for movement along the frame. The depth of the notch 46 is such that adequate clearance is provided at the end of the ram guide 24 to permit it to move smoothly along the axis of the frame member 8 while restricting the longitudinal movement of the ram guide. The ram guide may be formed from a single piece of metal by stamping or forging.

The frame members are illustrated as H beams with the ears 48 and 50 moving along the wider flat surfaces. If desired, the frame members may be positioned at a 90° angle from that shown, the choice being dependent upon the particular clamping mechanism used for the carriage 6. If one elects to use the clamping mechanism described in my co-pending application Ser. No. 53,199, it is desirable to position the frame members at an angle of 90° from that shown in the drawing.

It is important that the surface of the ram guide 24 slope downwardly away from the conical center section 30, as stated above, so that the outside edge of the log will not rest on the ram guide. However, it is important also that the vertical distance between the point where the ram head 26 engages the ram guide and the level of the ears 48 and 50, as indicated by the dimension "g" in FIG. 4, be as short as possible so that a minimal sideways rocking movement of the ram guide will not cause the ear 48 and 50 to bind on the frame. The angle "c" of 15 degrees between the horizontal and a line connecting the the end of the ram guide at ears 48 and 50 with the apex of the conical section 30 meets both of these requirements in a satisfactory manner. The angle used will depend somewhat upon the size and structure of the splitter, but preferably will be be at least 10 degrees and not more than 20 degrees.

The ram guide 24 is maintained in engagement with the ram head 26 by two tension springs 51 and 51*a* which are secured at one end by ears 52 and 52*a* to the ram guide and which extend downwardly and outwardly at an angle and are secured at their opposite ends to the base 14. These springs permit vertical movement of the ram guide and also permit it to tilt when the twisting moments are applied and return it to a horizontal position when the force is removed.

In use, the lower end of a log to be split, indicated in broken lines at 53 in FIG. 1, is placed on the conical section 30 and held in place while the carriage clamps 10 and 10*a* are released and the splitting wedge 2 lowered to make contact with the upper end of the log. The hydraulic jack 20 is then actuated, for example by a power mechanism as described in the above-identified copending application, forcing the ram guide 24 upwardly and causing the wedge 2 to penetrate and split the log. Because both weight and economy are essential to a log splitter intended for home use, the frame members must be relatively light in weight, a condition that is possible only if the predominate forces applied to the frame members 8 and 8*a* are tensile forces parallel with the axes of the frame members. The generation of twisting moments is minimized by the conical support 30 which is positioned in line with the point 54 of the wedge 2. Because of the shape of the ram guide and the downwardly sloping surfaces 40 and 40*a*, only the center portion of the log makes contact with the ram guide. The conical section 30 will make some penetration of the log, but it is important that this penetration be limited and that the log not make contact with the ram guide at any point other than the conical section 30. In practice, the section 30, which has a partially conical surface in order to limit the width of the ram guide 24, may have a diameter, in the lengthwise direction of the ram guide, indicated by the dimension "e" in FIG. 2, of about 3 inches. The conical section 30, crosswise of the ram guide has a dimension "f" of about 2 inches. By a conical surface is meant a surface of any circumferential shape generally tapering to a point or other shape that will prevent the log from slipping sideways when the splitting force is applied. For example such a conical surface could be generally rounded with a central projection or point to anchor the log, or it could be such a rounded surface with a smaller flat top on which the log can rest.

If the conical section 30 is too small, it will penetrate the log, particularly when softer woods are being split, and allow the log to make contact with the surface 40 or 40*a* of the ram guide and generate excessive twisting moments that if the splitting action were not aborted would distort the frame members 8 and 8*a*. If the conical section 30 is too large, excessive twisting moments may be generated by contact with the conical section itself. If the relatively steep angle of thirty degrees or so is maintained over the full width of an excessively large conical section, trouble may be experienced with binding of the ram guide on the members 8 and 8*a* as a result of the greater vertical distance from the point of engagement between the ram head 26 and the ram guide 24 to the ends of the ram guide where they are in sliding engagement with the frame members 8 and 8*a*. In practice, the surface of the conical section 30 may have an area as little as one square inch and a maximum area of as much as 12 square inches.

The angle of the conical surface from the horizontal is shown as 30 degrees and preferably is between 25 and 35 degrees. The angle "b" between the horizontal and the surfaces 40 and 40*a* is illustrated as 8½ degrees and is preferably between 6 and 12 degrees.

For the most part, logs to be split do not have exactly perpendicular ends and, if the angle of cut is large enough, one edge of the log may make contact with the upper surface 40 or 40*a* of the ram guide. This can usually be prevented by rotating the log around its longitudinal axis or turning it end for end. If the outer edge of the log is allowed to make contact with the ram guide, the ram guide will tilt during the splitting action, to prevent the build up of excessive twisting moments, making it necessary to stop the splitting action and remove the log.

Figure 5:
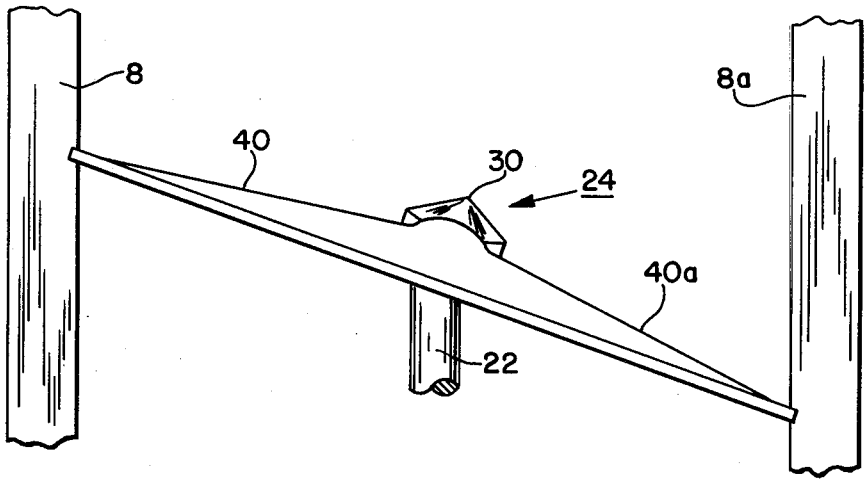
FIG. 5 is a partial front view showing the position of the ram guide when the splitting operation generates substantial twisting moments.
Figure 6:
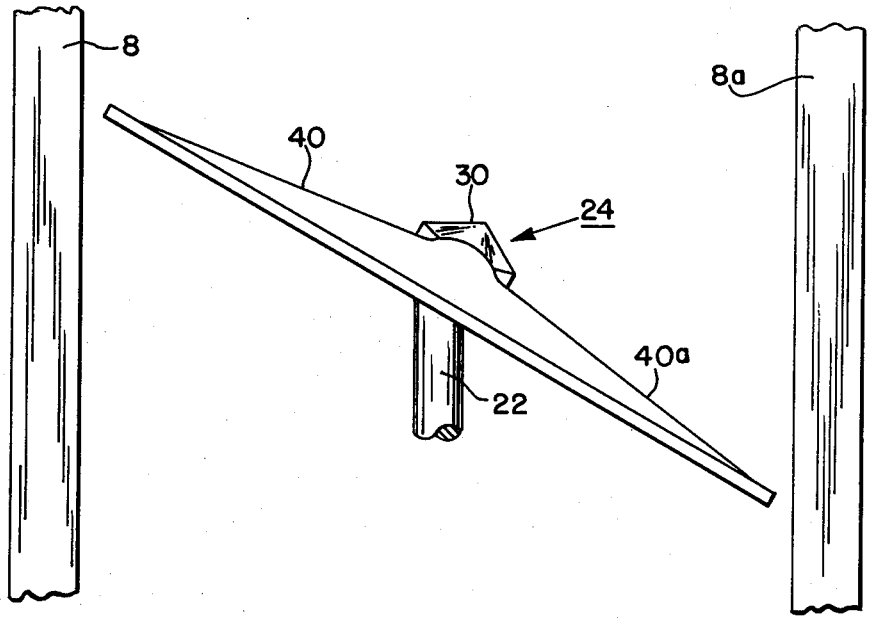
FIG. 6 is a similar view illustrating the position of the ram guide under greater twisting monments and in position to cause the splitting operation to abort.

Excessive twisting moments of sufficient magnitude to permanently distort the frame members 8 and 8*a* may be caused by variations in the density of the wood, because of knots or other reasons, or by the direction of the grain of the wood, which may not always be parallel with the direction of movement of the log during the splitting operation. The ram guide 24 serves two functions when such excessive twisting moments are encountered. The eccentric force causes the ram guide to tilt on the conical surface of the ram head 26, as illustrated in FIG. 5. This visual indication of the presence of excessive twisting moments permits the operator to stop the splitting action and remove or re-position the log. However, if the operator fails to stop the splitting action, no damage is done to the frame of the unit because the splitting action is automatically aborted. As shown in FIG. 6, when the angle of tilt reaches a critical limit, one or both of the retaining notches 46 and 46*a* retreat from the frame members enough that the ears 48 and 50 can no longer serve to restrict the lateral movement of the ram guide and the entire assembly including the ram guide 24 and the jack 20 topples over.

The jack 20 has no lateral stability. Because the jack is not required to resist lateral movement, it can be much lighter construction than would otherwise be reqired. The lateral stability in the horizontal plane, while the ram guide is horizontal or not tilted enough to disengage, is provided by the notches in the ram guide cooperating with the frame members.

From the foregoing it will be seen that my invention makes it possible to fabricate a log splitter of lighter weight and lower cost than would be possible without the protection provided by the visual indication and fail-safe operation of the ram guide. It will be seen that the invention is subject to a variety of modifications in form and structure to best adapt it to each particular log splitter design and construction.

I claim:

1. In a log splitter having first and second frame members, support means retaining said frame members in spaced parallel relationship, and a carriage supported by said frame members and having a splitting wedge adapted to engage a log to be split, the improvement comprising a ram guide extending between said frame members and adapted to engage said log at a point opposite said wedge, guide means at each end of said ram guide and arranged to cooperate with the respective frame member to direct the movement of said ram guide along a path parallel with said frame members, said guide means defining means for releasing said ram guide from such directed movement when the angle of tilt of the said ram guide with respect to said frame members exceeds a predetermined angle, and means for producing relative closing movement between said ram guide and said wedge.

2. A log splitter as claimed in claim 1 wherein said means for producing relative closing movement includes a ram having a driving end and wherein said ram guide tiltably engages said driving end.

3. A log splitter as claimed in claim 1 wherein said means for producing relative closing motion includes a ram having a tapered driving end and said ram guide has a conforming socket area receiving said driving end.

4. A log splitter as claimed in claim 1 wherein said means for producing relative closing movement includes a ram having a driving end of gradually reduced cross sectional area, and said ram guide has a socket portion shaped to conform with and to receive said driving end of said ram.

5. A log splitter as claimed in claim 1 including means normally supporting said ram guide in a horizontal position and wherein said ram guide includes a central area, adapted to engage the lower end of a vertically-positioned log that is to be split, and has opposing surfaces extending outwardly from said central area and sloping downwardly away from the end of said log.

6. A log splitter as claimed in claim 5 wherein, when said ram guide is in a horizontal position, a line extending between the center of said central area and one outer end of said ram guide forms an angle of approximately 15 degrees from the horizontal.

7. A log splitter as claimed in claim 6 wherein said angle is between 10 and 20 degrees.

8. A log splitter as claimed in claim 5 wherein said central area has an area between one and 12 square inches.

9. A log splitter as claimed in claim 1 wherein at least one of said guide means includes a pair of ears extending on opposite sides of one of said frame members.

10. A log splitter as claimed in claim 9 wherein said ears are formed by a notch in the end of said ram guide, said notch having a base positioned adjacent the inner surface of one of said frame members and operating to limit the longitudinal movement of said ram guide.

11. In a log splitter having first and second vertical frame members, support means retaining said frame members in spaced parallel relationship, and a carriage supported by said frame members and having a splitting wedge adapted to engage the upper end of a vertically-positioned log to be split, the improvement comprising a ram guide extending between said frame members and adapted to engage the lower end of said log at a point opposite said wedge, guide means at at least one end of said ram guide and arranged to cooperate with two opposing surfaces of the respective frame member to direct the movement of said ram guide along a path parallel with said frame members, said guide means defining means for releasing said ram guide from such directed movement when the angle of tilt of the said ram guide with respect to said frame members exceeds the predetermined angle, and a hydraulic jack having a ram tiltably engaging said ram guide for producing relative closing movement between said ram guide and said wedge, and a base supporting said jack and forming part of said support means.

12. A log splitter as claimed in claim 11 wherein said ram guide has a generally V-shaped upper surface with the apex thereof positioned substantially midway between said frame members.

13. A log splitter as claimed in claim 12 wherein said ram guide, when positioned with its longitudinal axis substantially perpendicularly to the longitudinal axes of said frame members, has first and second sloping surfaces respectively forming first and second angles of inclination with respect to a line extending perpendicularly to the longitudinal axes of said frame members, said first sloping surface being immediately adjacent said apex and said first angle of inclination being greater than said second angle of inclination.

14. A log splitter as claimed in claim 13 wherein said first angle of inclination is between 25 and 35 degrees.

15. A log splitter as claimed in claim 14 wherein said second angle of inclination is between 6 and 12 degrees.

* * * * *